US008776733B2

(12) United States Patent
Haddad et al.

(10) Patent No.: US 8,776,733 B2
(45) Date of Patent: Jul. 15, 2014

(54) VALVE SHANK MOUNT ASSEMBLY FOR A WATER HEATER

(75) Inventors: Bill Haddad, Garden Grove, CA (US); Raymond Joubran, Pasadena, CA (US)

(73) Assignee: Robertshaw Controls Company, Carol Stream, IL (US)

( * ) Notice: Subject to any disclaimer, the term of this patent is extended or adjusted under 35 U.S.C. 154(b) by 1542 days.

(21) Appl. No.: 12/392,866

(22) Filed: Feb. 25, 2009

(65) Prior Publication Data

US 2010/0212602 A1 Aug. 26, 2010

(51) Int. Cl.

| | |
|---|---|
| ***F02M 51/00*** | (2006.01) |
| ***F24H 9/20*** | (2006.01) |
| ***F23N 1/08*** | (2006.01) |
| ***F23N 1/00*** | (2006.01) |
| ***F23N 5/02*** | (2006.01) |

(52) U.S. Cl.

CPC ..... *F24H 9/2035* (2013.01); *F23N 1/087* (2013.01); *F23N 2041/04* (2013.01); *F23N 1/007* (2013.01); *F23N 2900/05005* (2013.01); *F23N 5/027* (2013.01); *F23N 2035/16* (2013.01)

USPC ..... 122/494; 122/17.1; 122/19.2; 374/208

(58) Field of Classification Search

USPC ..... 122/13.01, 17.1, 19.2, 494, 498; 374/141, 147, 148, 163, 208; 285/330–331

See application file for complete search history.

(56) References Cited

U.S. PATENT DOCUMENTS

| | | | | | |
|---|---|---|---|---|---|
| 230,958 | A | * | 8/1880 | McKelvey | 122/498 |
| 3,319,980 | A | * | 5/1967 | Demetriff et al. | 285/123.3 |
| 3,447,746 | A | * | 6/1969 | Visos | 236/21 B |
| 3,691,501 | A | * | 9/1972 | Katchka et al. | 337/393 |
| 3,992,137 | A | | 11/1976 | Streisel | |
| 4,025,291 | A | | 5/1977 | Black | |
| 4,197,831 | A | | 4/1980 | Black | |
| 4,235,323 | A | | 11/1980 | Dykzeul | |
| 4,353,348 | A | | 10/1982 | Black | |
| 4,422,844 | A | | 12/1983 | Graham et al. | |
| 4,432,336 | A | | 2/1984 | Black | |
| 4,651,714 | A | | 3/1987 | Granberg | |
| 4,685,425 | A | | 8/1987 | Eising | |
| 4,729,396 | A | | 3/1988 | Kelly et al. | |
| 4,742,800 | A | | 5/1988 | Eising | |
| 4,787,414 | A | | 11/1988 | Kelly et al. | |
| 4,790,268 | A | | 12/1988 | Eising | |
| 4,830,039 | A | | 5/1989 | Kelly et al. | |
| 4,921,011 | A | | 5/1990 | Kelly et al. | |
| 4,971,095 | A | | 11/1990 | Kelly et al. | |
| 5,044,390 | A | | 9/1991 | Kelly et al. | |
| 5,294,907 | A | * | 3/1994 | Katchka | 337/394 |
| 5,348,037 | A | * | 9/1994 | Katchka | 137/15.17 |
| 5,419,356 | A | * | 5/1995 | Katchka | 137/15.09 |
| 5,462,315 | A | * | 10/1995 | Klementich | 285/24 |
| 5,620,016 | A | * | 4/1997 | Katchka | 137/15.08 |
| 5,754,090 | A | | 5/1998 | Arensmeier | |

(Continued)

*Primary Examiner* — John K Fristoe, Jr.
*Assistant Examiner* — Jessica Cahill
(74) *Attorney, Agent, or Firm* — Reinhart Boerner Van Deuren P.C.

(57) ABSTRACT

A shank mount assembly for a water heater that includes an annular nipple having an opening, the nipple configured to removably attach to an opening in a water heater tank. The shank mount assembly further includes an annular shank mount having an opening, the shank mount configured to removably attach to the nipple, wherein the shank mount is further configured to attach to a gas valve assembly.

20 Claims, 6 Drawing Sheets

(56) References Cited

U.S. PATENT DOCUMENTS

| | | | | |
|---|---|---|---|---|
| 6,026,804 | A | 2/2000 | Schardt et al. | |
| 6,394,042 | B1 | 5/2002 | West | |
| 6,488,408 | B1 * | 12/2002 | Laflamme et al. | 374/150 |
| 6,517,344 | B2 * | 2/2003 | Scanlon | 431/343 |
| 6,553,946 | B1 * | 4/2003 | Abraham et al. | 122/14.22 |
| 6,739,517 | B1 | 5/2004 | Krueger | |
| 7,131,462 | B1 | 11/2006 | Chen | |
| 7,392,766 | B2 * | 7/2008 | Jackson | 122/14.3 |
| 2002/0171241 | A1 * | 11/2002 | Duong et al. | 285/305 |
| 2003/0033990 | A1 * | 2/2003 | Inoue et al. | 122/6 A |
| 2008/0238094 | A1 * | 10/2008 | Craig et al. | 285/331 |

* cited by examiner

VALVE SHANK MOUNT ASSEMBLY FOR A WATER HEATER

FIELD OF THE INVENTION

This invention generally relates to water heating systems, and more specifically to a valve shank mount assembly for a water heating system.

BACKGROUND OF THE INVENTION

It has been standard practice in the industry to use a machined brass or steel component, known as a shank mount, to mount a gas valve assembly to a water heater tank. FIG. 6 illustrates a prior art gas valve and shank mount assembly 110 having a gas valve assembly 112 configured to regulate the flow of gas to a water heating system (not shown). A brass shank mount 114 having an interior wall 116, an exterior wall 118 and a central opening 120 is assembled to gas valve assembly 112. An elongate temperature probe assembly 122 is configured to sense the temperature of water in a water heater tank (not shown). The temperature probe assembly 122 includes an invar rod 124 disposed within a copper tube 126, and is assembled to gas valve assembly 112 such that the temperature probe assembly 122 protrudes from the gas valve assembly 112 through the central opening 120 in the brass shank mount 114.

One purpose of this brass shank mount 114 is to provide a mounting means for a temperature sensing probe which is assembled to components configured to open or close the flow of gas in a particular channel of the gas valve assembly 112. Generally, the copper tube 126 and invar rod 124 assembly is configured to be positioned inside the water heater tank. The copper tube 126, having a high thermal coefficient of expansion, expands and contracts as the water temperature in the tank increases and decreases, respectively. The expansion and contraction of the copper tube 126 acts to move the invar rod 124. The invar rod 124 may be configured to push against a lever 128, which causes the gas valve assembly 112 to allow the main gas or bleed gas to flow to the outlet of the valve or to an adjacent gas chamber.

Another purpose of the brass shank mount 114 is to provide a rigid means for mounting the gas valve assembly 112 to the water heater tank using, for example, an external threaded feature on the brass shank mount 114. This allows the gas valve and shank mount assembly 110 to be assembled to the water heater tank and aligned vertically by means of a turning torque. Generally, the gas valve and shank mount assembly 110 is aligned vertically to receive the incoming gas supply. In some cases a relatively high amount of torque is applied to the gas valve and shank mount assembly 110 in order to achieve this vertical alignment.

The temperature set point that is indicated on a temperature dial for the water heating system may be controlled by the position of the lever 128 with respect to the invar rod 124 at a specific water temperature sensed by the copper tube 126. The position of the invar rod 124 with respect to the lever 128 is maintained by the brass shank mount 114 and the copper tube 126. If an excessive amount of torque is used to align the gas valve and shank mount assembly 110 in the vertical position, or if excessive bending moments are applied to the gas valve and shank mount assembly 110, the position of the invar rod 124 may be shifted. That change in position may then affect the temperature calibration of the gas valve and shank mount assembly 110 as set at the factory. It is typical in current brass shank mount designs that a considerable amount of torque (i.e., enough to change the position of the invar rod) may be applied to the brass shank mount 114 during vertical alignment of the gas valve and shank mount assembly 110 on the water heater tank.

A third purpose of the brass shank mount 114 is to provide a water-tight seal between the interior and exterior of the water heater tank. The brass alloys typically used to make the brass shank mount 114 have a low corrosion rate when compared to other metal alloys such as aluminum and steel. Brass is a suitable material for use in containing the high temperature, high pressure water inside the water heater tank. Any substitute material for the brass alloys should be able to withstand the high pressures and temperatures experienced in a water heater tank, and should meet or exceed the low corrosion rate of the brass alloys when exposed to water at such pressures and temperatures.

Brass alloys, however, are expensive when compared to alloys of aluminum and steel. Additionally, brass shank mounts 114 must typically be made in a number of differing lengths and diameters to accommodate the variety of water heater tanks on the market. As such, the particular brass shank mount 114 to be used must typically be fitted to the gas valve assembly 112 before calibration of the temperature probe assembly 122 can be completed. As a result, the calibration step is delayed until the type of water heater to which the gas valve assembly 112 is to be attached is determined. Furthermore, as discussed, gas valve and shank mount assemblies 110 with brass shank mounts 114 may be over-torqued during vertical alignment or the valve. Some of the stresses from over-torquing may be transferred from the brass shank mount 114 to the invar rod 124 changing the temperature calibration of the gas valve and shank mount assembly 110.

It would therefore be useful to have a standard size shank mount for gas valve assemblies so that the temperature probes of all assemblies could be calibrated immediately after production. It would also be useful to have a shank mount assembly which uses less expensive materials than the brass alloys commonly used today, and which does not render the temperature sensing probe on the gas valve assembly as susceptible to calibration shift from over-torquing as machined brass shank mounts.

The embodiments of the invention provide such a solution to one or more of the aforementioned problems. These and other advantages of the invention, as well as additional inventive features, will be apparent from the description of the invention provided herein.

BRIEF SUMMARY OF THE INVENTION

In one aspect of the invention, a shank mount assembly for a water heater that includes an annular nipple having an opening, the nipple configured to removably attach to an opening in a water heater tank. The shank mount assembly further includes an annular shank mount having an opening, the shank mount configured to removably attach to the nipple, wherein the shank mount is further configured to attach to a gas valve assembly.

In another aspect of the invention, an gas valve and shank mount assembly includes an annular nipple having a nipple opening, wherein the annular nipple is configured to removably attach to an opening in a water heater tank, an annular shank mount having a shank mount opening, and a gas valve having a temperature probe configured to fit through the nipple opening, the shank mount opening, and the tank opening, wherein the shank mount is configured to attach to the gas valve and removably attach to the nipple.

In yet another aspect of the invention, a water heating system that includes a tank configured to hold water, the tank having an opening configured to accept a temperature probe. The water heating system also includes a gas valve and shank mount assembly that has an annular nipple having a nipple opening, wherein the annular nipple is configured to removably attach to the tank at the tank opening, an annular shank mount having a shank mount opening, and a gas valve including the temperature probe, wherein the temperature probe is configured to fit through the nipple opening, the shank mount opening, and the tank opening, and wherein the shank mount is configured to attach to the gas valve and removably attach to the nipple.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
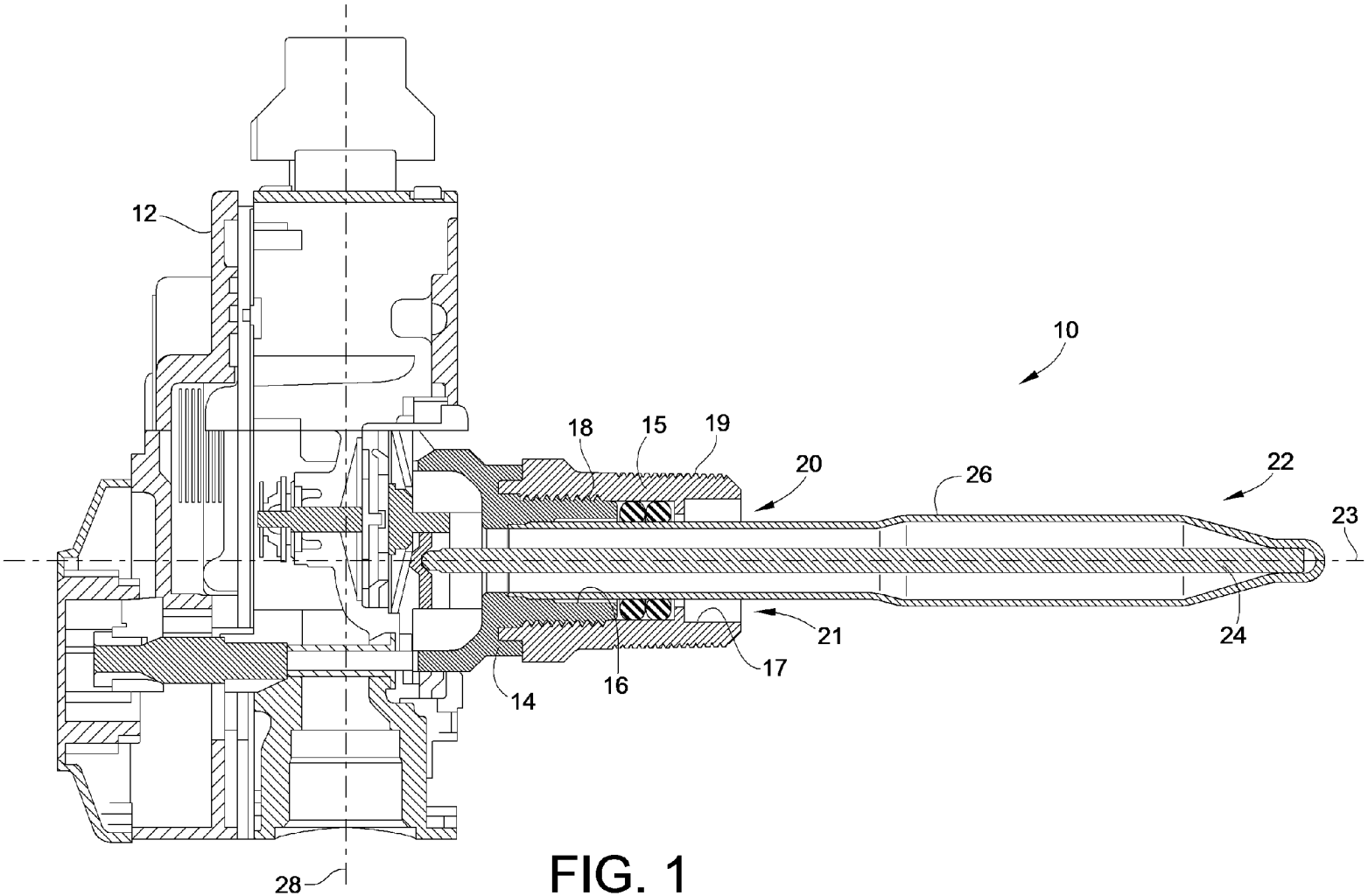
FIG. 1 is a cross-sectional view of a gas valve and shank mount assembly according to an embodiment of the invention.

FIG. 1 illustrates a gas valve and shank mount assembly 10 according to an embodiment of the invention, having a gas valve assembly 12 configured to regulate the flow of gas to a water heating system (not shown). A shank mount 14, having a longitudinal axis 23, an interior wall 16, an exterior wall 18 and a central opening 20 parallel to longitudinal axis 23, is assembled to gas valve assembly 12. In an embodiment of the invention, the shank mount 14 is annular. In the embodiment shown, exterior wall 18 is threaded. A nipple 15, having longitudinal axis 23, an interior surface 17, an exterior surface 19 and a center opening 21 parallel to longitudinal axis 23, is assembled onto shank mount 14. In the embodiment shown, interior surface 17 is threaded to facilitate assembly of the nipple 15 to the shank mount 14. The exterior surface 19 is also threaded to facilitate assembly to a water heater tank (not shown). An elongate temperature probe assembly 22 is configured to sense the temperature of water in the water heater tank. The temperature probe assembly 22, which shares longitudinal axis 23 with the shank 14 and nipple 15, includes an invar rod 24 disposed within a copper tube 26, and is assembled to gas valve assembly 12 such that the invar rod 24 and copper tube 26 protrude from the gas valve assembly 12 through the central opening 20 in the shank mount 14, and through the center opening 21 in the nipple 15. In an embodiment of the invention, the temperature probe assembly 22 protrudes approximately at a right angle to a longitudinal axis 28 of the gas valve assembly 12, however it is contemplated that the temperature probe assembly 22 may be assembled at various angles to the longitudinal axis 28 of the gas valve assembly 12.

Figure 2:
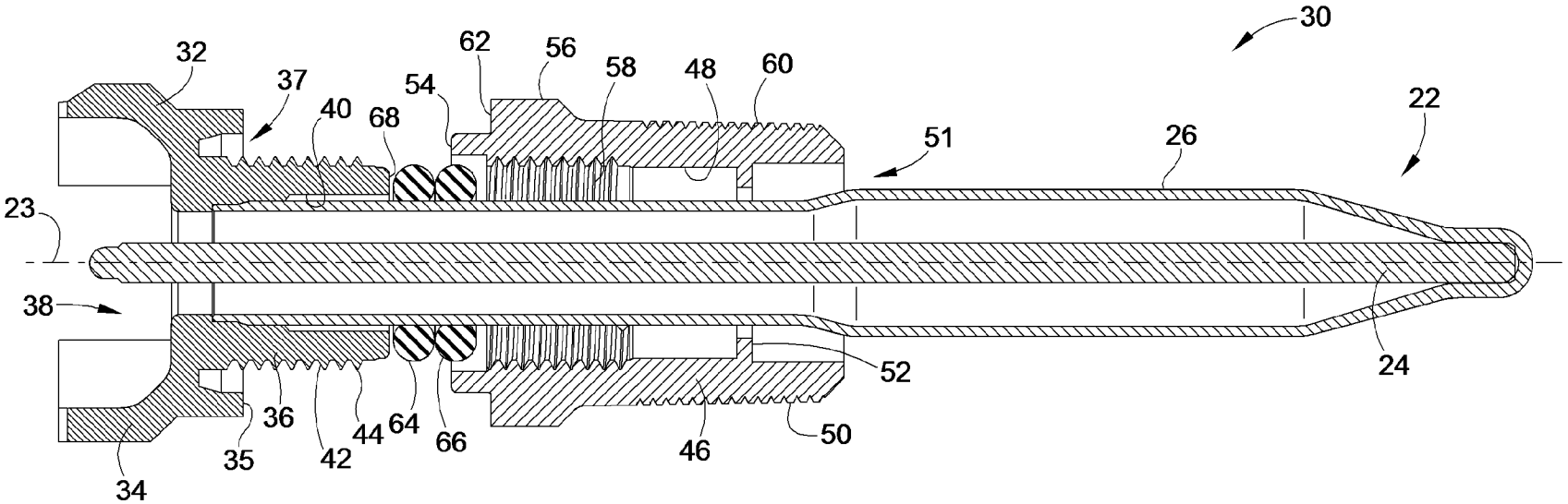
FIG. 2 is a cross-sectional view of a portion of the gas valve and shank mount assembly according to an embodiment of the invention.
Figure 3:
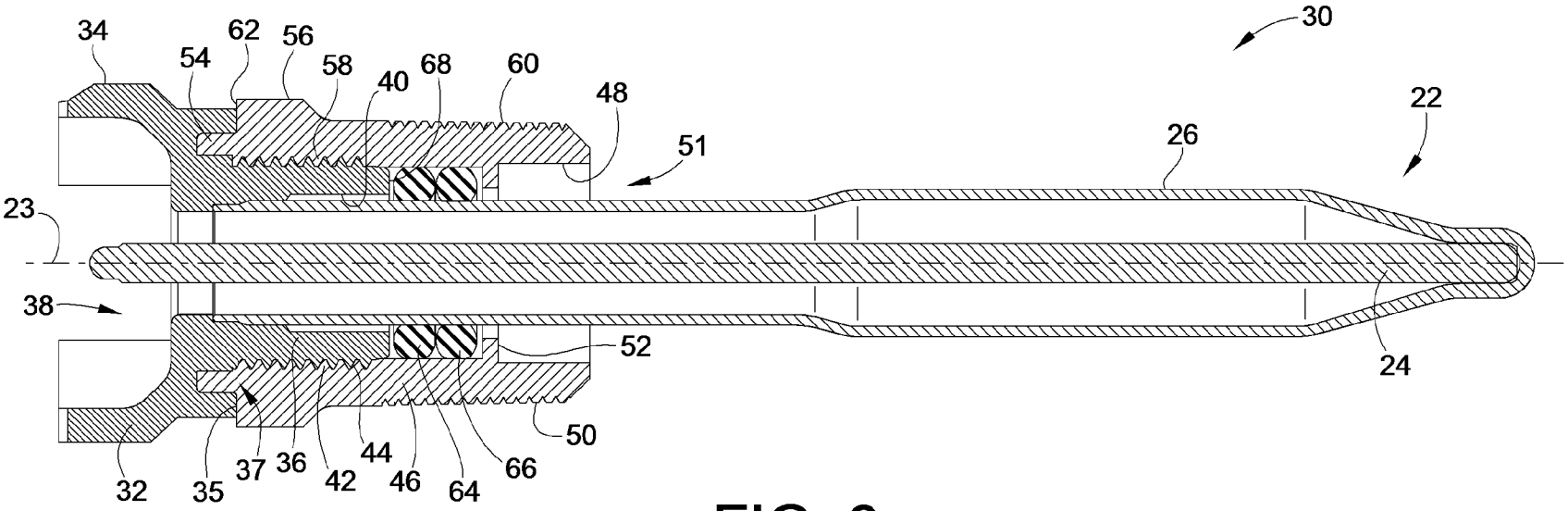
FIG. 3 is a cross-sectional view of a portion of the gas valve and shank assembly according to an embodiment of the invention.

FIGS. 2 and 3 illustrate a shank mount assembly 30 according to an embodiment of the invention. The shank mount assembly 30 includes a shank mount 32 having a base portion 34 and a threaded portion 36, and includes the temperature probe assembly 22 positioned through a central opening 38 of the shank mount 32. In one embodiment, the shank mount 32 is annular. The threaded portion 36 includes an interior wall 40 and an exterior wall 42 with threads 44 to allow attachment of the shank mount 32 to a nipple 46. In an embodiment of the invention, the nipple 46 is also annular. At the junction of the base portion 34 and threaded portion 36, the base portion 34 has a projection 35 that extends parallel to the exterior wall 42 of the threaded portion 36 such that a groove 37 is formed between the exterior wall 42 on the inside and the projection 35 on the outside. In an embodiment of the invention, the projection 35 and the shank mount groove 37 are annular.

Figure 6:
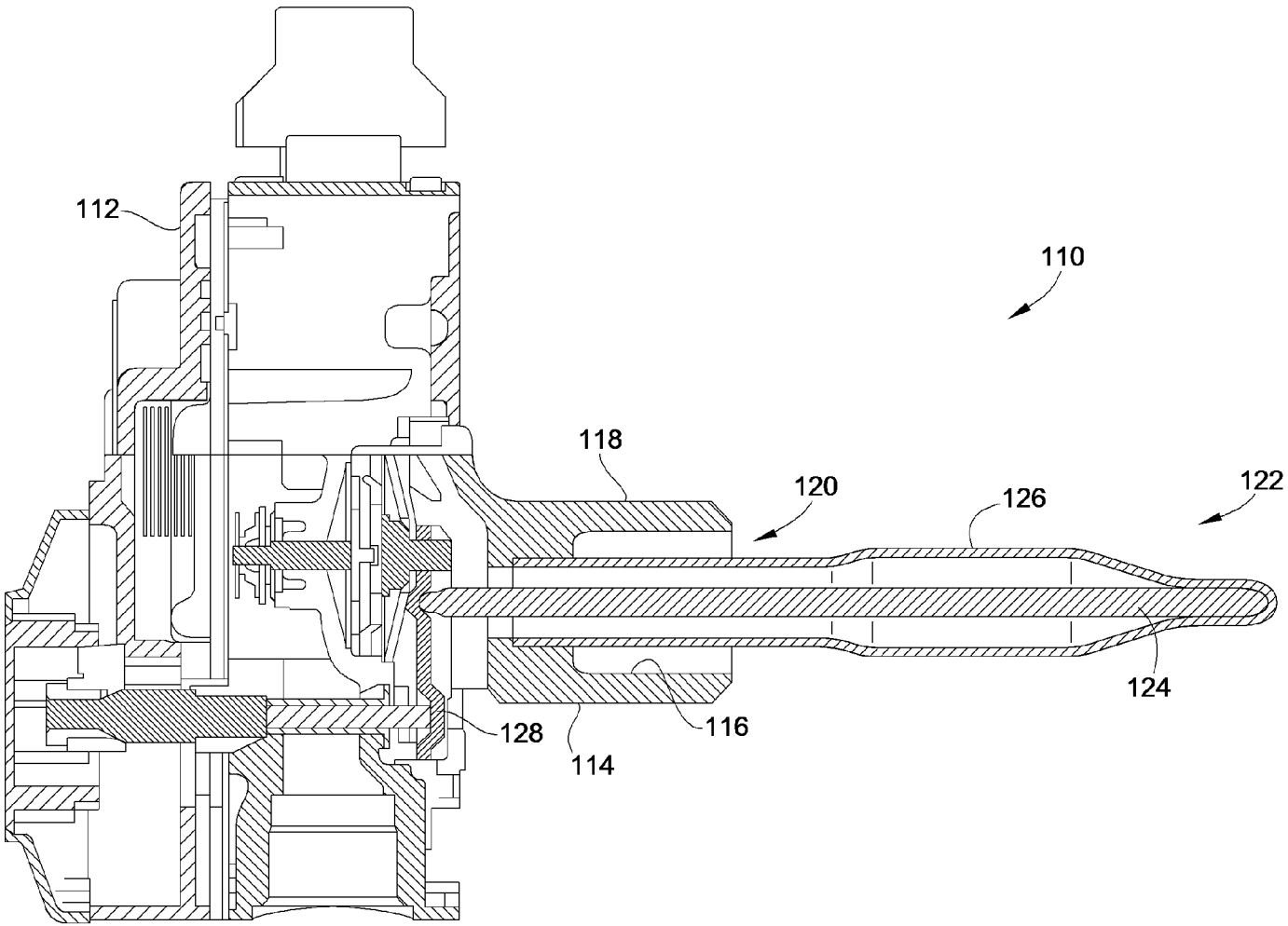
FIG. 6 PRIOR ART
FIG. 6 is a cross-sectional view of a prior art gas valve and shank mount assembly.

In the embodiments of the invention disclosed herein, the shank mount 32 can be made from aluminum, an aluminum alloy, steel, a steel alloy, zinc, a zinc alloy, magnesium or a magnesium alloy, all of which are generally less expensive than the brass alloys typically used to make brass shank mounts 114 (shown in FIG. 6). Such a shank mount 32 made from aluminum, steel and alloys thereof may be attached to the gas valve assembly 12 using screws or other suitable means of attachment. As for the attachment to the water heater tank, the shank mount 32 may be threaded into a threaded opening in the tank, joined to the tank opening using screws, or attached to the tank opening by other suitable means.

The nipple 46 has an inner wall 48, an outer wall 50, and a center opening 51. In an embodiment of the invention, the nipple 46 includes a flange 52 that projects inward from the inner wall 48, and a protrusion 54 at one end of the nipple 46. In one embodiment, the protrusion 54 is annular and extends axially from a lipped portion 56 of the nipple 46. The nipple 46 further includes interior threads 58 formed on a portion of the inner wall 48 and exterior threads 60 formed on a portion of the outer wall 50.

The nipple 46 may be constructed from plastic or some other material, aluminum for example, capable of withstanding the elevated temperatures and pressures of water in the water heater tank. Specifically, the nipple material should have a low corrosion rate in the presence hot water. The material must also be durable enough such that the nipple 46 does not require frequent replacement. Typically, a nipple 46 made from plastic can be combined with the steel or aluminum shank mount 32 at less cost than the single machined brass shank mount 114, see e.g., FIG. 6, commonly used today.

The nipple 46 is configured to be assembled onto the shank mount 32 with the temperature probe assembly 22 positioned through the center opening 51 of the nipple 46. The interior threads 58 are configured to mate with the threads 44 on the shank mount 32. As the nipple 46 is threaded onto the shank mount 32, the protrusion 54 seats into the groove 37. When the protrusion 54 is fully seated in the groove 37, as shown in FIG. 3, the tip of the projection 35 is flush against a lip 62 of lipped portion 56. A pair of O-rings 64, 66 is positioned between the flange 52 and an end 68 of the shank mount 32. When the nipple 46 is fully seated onto the shank mount 32, the O-rings 64, 66 are configured to create a water-tight seal between the nipple 46 and the copper tube 26 of the temperature probe assembly 22 that keeps water from leaking out of the water heater tank (not shown). In other embodiments, one seal may be configured to create the water-tight seal between the nipple 46 and copper tube 26.

The seating of the protrusion 54 into the groove 37 creates a mechanical locking feature that serves to support the shank mount 32 where moment stresses could be concentrated in the event of overload. Such an overload could be the result of excessive forces applied in a direction perpendicular to the longitudinal axis 23 of the shank mount 32, such as someone standing on the gas valve assembly 12. The locking feature reduces deformation of the nipple 46 when under load, and reduces the likelihood of the interior threads 58 on the nipple 46 from disengaging from the threads 44 on the shank mount 32, thus enabling the shank mount 32 and nipple 46 to bear a torque-producing load without either breaking or disengaging. The groove 37 in the shank mount 32 can also provide containment for stress cracks in the body of the nipple 46 and prevents those cracks from propagating to the end of the nipple 46 having the protrusion 54.

Figure 4:
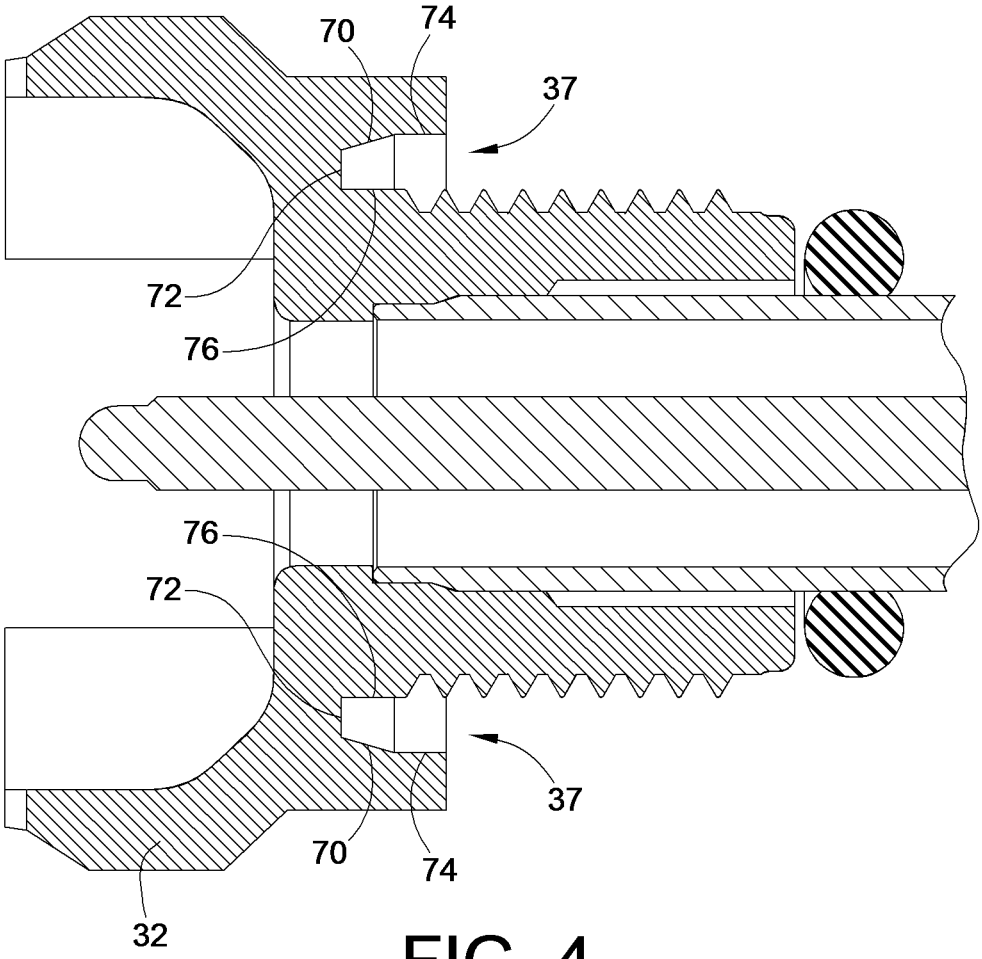
FIG. 4 is a cross-sectional view of a portion of the gas valve and shank assembly shown in FIG. 2 according to an embodiment of the invention.

Referring to FIG. 4, the groove 37 in the shank mount 32 may include a chamfer 70 at the closed end or bottom side 72 of the groove 37. A typical angle for the chamfer 70 is approximately 15 degrees, that is, the angle of a side wall 74 is altered approximately 15 degrees such that, instead of the side wall 74 intersecting the bottom side 72 of the groove 37 at a right angle, the side wall 74 with the chamfer 70 intersects the bottom side 72 at approximately 105 degrees. However, it is contemplated that other chamfer angles may be used. The chamfer 70 is configured to engage with the protrusion 54 as the nipple 46 is threaded onto the shank mount 32. The additional friction created between the protrusion 54 and the side wall 74 with the chamfer 70, as the protrusion 54 seats in the groove 37, enhances the locking feature of the shank mount 32 and nipple 46. In alternate embodiments of the invention, a second side wall 76 of the groove 37 may be chamfered, or both side walls 74, 76 may be chamfered.

Figure 5:
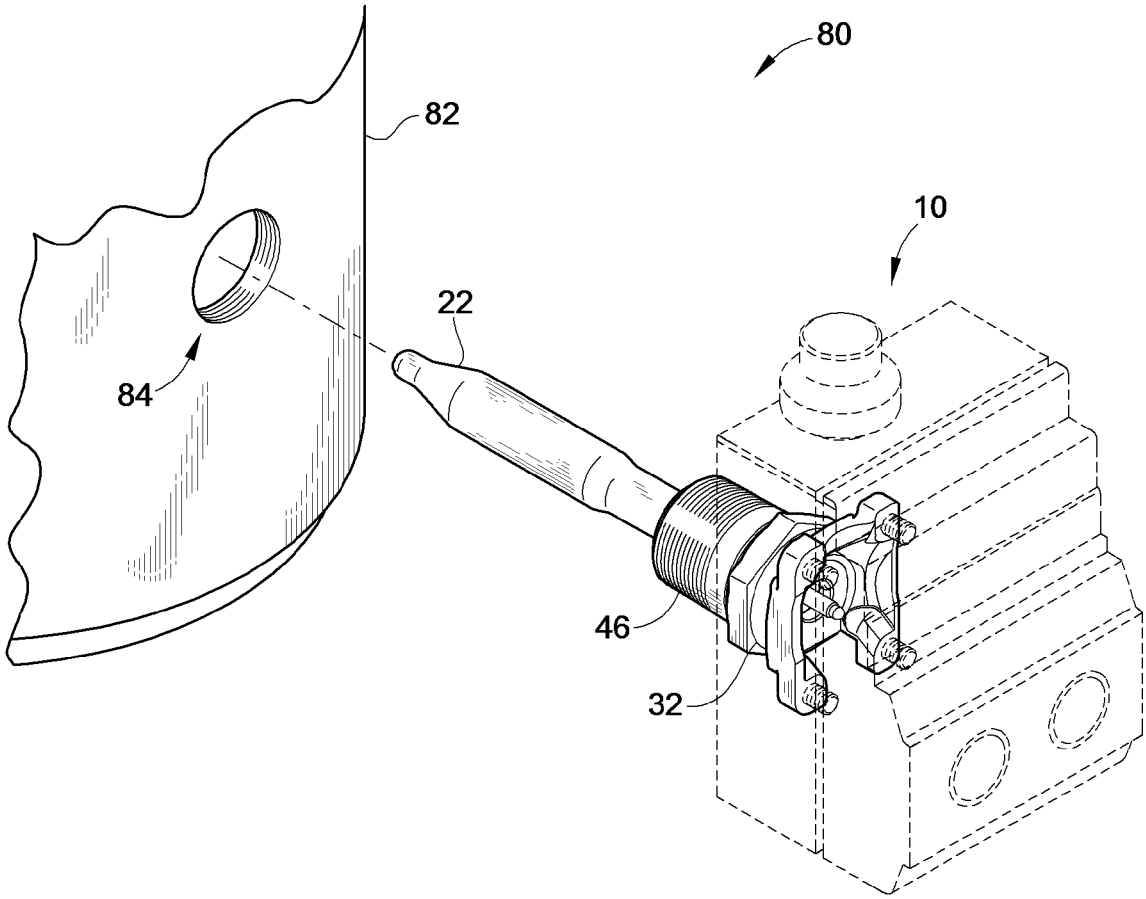
FIG. 5 is a pictorial view of a portion of a water heating system incorporating an embodiment of the invention.

A partial view of a water heating system 80 is illustrated in FIG. 5 according to an embodiment of the invention. The water heater tank 82 has an opening 84 configured to receive the nipple 46. In an embodiment of the invention, the nipple 46 is threaded and assembled into the opening 84 which is also threaded. When assembled to the water heater tank 82, the nipple 46 is in contact with the heated water inside the water heater tank 82. The O-rings 64, 66 (shown in FIG. 2) are configured to prevent water from leaking outside of the water heater tank 82. The gas valve and shank mount assembly 10 can be attached to the water heater tank 82 by inserting the temperature probe assembly 22 through the opening 84 then threading the shank mount 32 into the nipple 46. However, it is also possible to assemble the nipple 46 onto the shank mount 32 first, and then thread the gas valve and shank mount assembly 10 with nipple 46 into the opening 84.

Such flexibility allows for the manufacture and calibration of temperature probes assemblies 22 without regard to the type or size of water heater tank on which the gas valve and shank mount assembly 10 will be used. While the nipple 46 can be made in a variety of lengths and diameters to accommodate the various water heater tanks on the market, the shank mount 32 can be standardized. By creating a standard shank mount 32 for all gas valve and shank mount assemblies 10, the manufacturer can also standardize the calibration of the temperature probe assembly 22 for each unit. Mass production and mass temperature calibration of gas valve and shank assemblies 10 results in reduced production costs. As stated above, gas valve and shank mount assemblies 110 (shown in FIG. 6) using machined brass shank mounts 114 (shown in FIG. 6), typically cannot be calibrated until the brass shank mount 114 is attached, which may not happen until it is known to which water heater tank 82 the gas valve and shank mount assembly 110 will be attached. These prior art gas valve and shank mount assemblies 110 typically have higher production costs associated with assembly of the machined brass shank mounts 114, and with calibration of the temperature probe assemblies 122 (shown in FIG. 6).

Still referring to FIG. 5, as mentioned, the nipple 46 can either be threaded into the opening 84 in the water heater tank 82 first, or threaded onto the shank mount 32 first. When the nipple 46 is threaded into the water heater tank 82 first, the gas valve and shank mount assembly 10 with shank mount 32 is threaded into the nipple 46 after inserting the temperature probe assembly 22 through the opening 84 into the water heater tank 82. Typically, during installation, the gas valve and shank mount assembly 10 has to be rotated to ensure proper alignment with the incoming gas supply. This may involve rotating the entire gas valve and shank mount assembly 10 including the temperature probe assembly 22 and shank mount 32.

For systems using brass shank mounts 114, it is possible that during alignment of the gas valve and shank mount assembly 110, an excessive amount of torque may be applied to the gas valve and shank mount assembly 110, thus affecting the calibration of the temperature probe assembly 22. For gas valve and shank mount assemblies 10 incorporating an embodiment of the invention, a shank mount 32 made of steel or aluminum, for example, can move easily within a nipple 46 made from plastic, for example, and therefore transfers less torque to the temperature probe assembly 22 than a gas valve and shank mount assembly 110 with a machined brass shank mount 114, see e.g., FIG. 6. The high torques and bending moments that may otherwise result from alignment of the gas valve and shank mount assembly 10 are transferred to the nipple 46, limiting the forces transferred to metal shank mount 32 and temperature probe assembly 22. As a result, the gas valve and shank mount assembly 10 with the nipple 46 and shank mount 32 is less likely to suffer from a calibration shift in the temperature probe assembly 22 than systems using machined brass shank mounts 114.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A shank mount assembly for a water heater, comprising:

an annular nipple having an opening, the nipple configured to removably attach to an opening in a water heater tank; and an annular shank mount having an opening, the shank mount configured to removably attach to the nipple;

wherein the shank mount is further configured to attach to a gas valve assembly; and wherein the nipple has, at one end, an annular protrusion configured to seat into an annular groove in the shank mount, the annular groove includes a first sidewall and a second sidewall, the first sidewall oppositely faces the second sidewall.

2. The shank mount assembly of claim 1, wherein an outer surface of the nipple is threaded.

3. The shank mount assembly of claim 1, wherein the nipple is configured to be threaded onto the shank mount.

4. The shank mount assembly of claim 1, wherein the nipple is made of plastic.

5. The shank mount assembly of claim 1, wherein the shank mount is made of one of a steel alloy, a zinc alloy, a magnesium alloy, and an aluminum alloy.

6. The shank mount assembly of claim 1, wherein a side wall of the annular groove includes a chamfer at the bottom side of the groove.

7. The shank mount assembly of claim 6, wherein an angle of the chamfer is approximately 15 degrees.

8. A gas valve and shank mount assembly comprising:

an annular nipple having a nipple opening, wherein the annular nipple is configured to removably attach to an opening in a water heater tank;

an annular shank mount having a shank mount opening; and a gas valve having a temperature probe configured to fit through the nipple opening, the shank mount opening, and the tank opening;

wherein the shank mount is configured to attach to the gas valve and removably attach to the nipple; and wherein the nipple has, at one end, an annular protrusion configured to seat into an annular groove in the shank mount, the annular groove includes a first sidewall and a second sidewall, the first sidewall oppositely faces the second sidewall.

9. The gas valve and shank mount assembly of claim 8, wherein the nipple is configured to be threaded into the opening in the water heater tank.

10. The gas valve and shank mount assembly of claim 8, wherein the nipple is configured to be threaded onto the shank mount.

11. The gas valve and shank mount assembly of claim 8, wherein the nipple is made of plastic.

12. The gas valve and shank mount assembly of claim 8, wherein the shank mount comprises one of steel, a steel alloy, aluminum, and an aluminum alloy.

13. The gas valve and shank mount assembly of claim 8, wherein the gas valve and shank mount assembly further comprises an O-ring positioned to create a seal between the nipple and the temperature probe.

14. The gas valve and shank mount assembly of claim 8, wherein a side wall of the annular groove includes a chamfer at the bottom of the groove.

15. The gas valve and shank mount assembly of claim 14, wherein an angle of the chamfer is approximately 15 degrees.

16. A water heating system, comprising:

a tank configured to hold water, the tank having an opening configured to accept a temperature probe; and a gas valve and shank mount assembly comprising:

an annular nipple having a nipple opening, wherein the annular nipple is configured to removably attach to the tank at the tank opening;

an annular shank mount having a shank mount opening; and a gas valve including the temperature probe, wherein the temperature probe is configured to fit through the nipple opening, the shank mount opening, and the tank opening; and wherein the shank mount is configured to attach to the gas valve and removably attach to the nipple; and wherein the nipple has, at one end, an annular protrusion configured to seat into an annular groove in the shank mount, the annular groove includes a first sidewall and a second sidewall, the first sidewall oppositely faces the second sidewall.

17. The water heating system of claim 16, wherein the nipple is configured to be threaded into the opening in the tank.

18. The water heating system of claim 16, wherein the nipple is configured to be threaded onto the shank mount.

19. The water heating system of claim 16, wherein the nipple is made of one of plastic and aluminum.

20. The water heating system of claim 16, wherein the shank mount is made of one of steel, zinc, a magnesium alloy, and aluminum.

* * * * *